United States Patent [19]

Acocella et al.

[11] Patent Number: 4,747,907

[45] Date of Patent: May 31, 1988

[54] METAL ETCHING PROCESS WITH ETCH RATE ENHANCEMENT

[75] Inventors: John Acocella, Hopewell Junction; Lawrence D. David, Wappingers Falls, both of N.Y.

[73] Assignee: International Business Machines Corporation, Armonk, N.Y.

[21] Appl. No.: 924,702

[22] Filed: Oct. 29, 1986

[51] Int. Cl.[4] ..... C23F 1/00

[52] U.S. Cl. ..... 156/642; 156/664; 156/666; 134/2; 134/10

[58] Field of Search ..... 156/664, 666, 628, 642, 156/656; 134/2, 10

[56] References Cited

U.S. PATENT DOCUMENTS

| | | | |
|---|---|---|---|
| 1,188,870 | 6/1916 | Williamson | 156/642 |
| 2,886,420 | 5/1959 | Jones et al. . | |
| 3,306,792 | 2/1967 | Thurmel et al. | 156/642 |
| 3,532,568 | 10/1970 | Kovell et al. . | |
| 3,600,244 | 8/1971 | Wegener . | |
| 3,951,710 | 4/1976 | Basi | 156/642 |
| 3,962,005 | 6/1976 | Lerner | 134/10 |
| 4,287,002 | 9/1981 | Torok | 134/10 |
| 4,472,236 | 9/1984 | Tanaka et al. . | |
| 4,569,720 | 2/1986 | Schmitkons et al. | 156/646 |
| 4,587,043 | 5/1986 | Murray et al. | 134/3 |
| 4,629,636 | 12/1986 | Courduvelis et al. | 156/642 |
| 4,657,596 | 4/1987 | Murray et al. | 134/10 |
| 4,685,971 | 8/1987 | Murray et al. | 134/2 |

OTHER PUBLICATIONS

Weast, CRC Handbook of Chemistry and Physics 61st ed 1980–1981 pp. B-1.

*Primary Examiner*—Kenneth M. Schor
*Assistant Examiner*—Lori-Ann Cody
*Attorney, Agent, or Firm*—Wolmar J. Stoffel; Ira David Blecker

[57] ABSTRACT

A metal etching process involving an oxidation-reduction reaction where the metal being etched is oxidized and the active ingredient in the etchant solution is reduced, incorporates contacting said metal with an etching solution containing an active ingredient selected from the group consisting of ferric ions, ferricyanide ions, ceric ions, chromate ions, dichromate ions, and iodine, and introducing ozone into said etching solution to rejuvenate and agitate the solution.

15 Claims, No Drawings

METAL ETCHING PROCESS WITH ETCH RATE ENHANCEMENT

BACKGROUND OF THE INVENTION

This invention is directed to a metal etching process involving contacting a metal with an etching solution containing a metal ion or a complex ion in a first valence state which is reduced to a lower valence state, resulting in oxidizing the metal being etched, thereby forming a metal ion which goes into the solution. More specifically, the invention relates to a process for etching metals that normally have slow etch rates, which process greatly enhances the etch rate of the metals, and provides for rejuvenation of the etching solution.

The general concept of etching metals, particularly copper, with an etchant solution containing an ion in a first valence state that is reduced to a lower valence state by an oxidizing reaction with copper, and forming an ion, is well known and widely used. The process applied to etching copper with ferric chloride solutions is described in U.S. Pat. No. 1,969,678. Various techniques to rejuvenate the etching solution by oxidizing the oxidizing ion in solution back to the original first valence state is well known, as indicated by U.S. Pat. Nos. 2,886,420, 3,600,244, and 3,532,568.

Normally, the etching of copper by such processes proceeds at an acceptable rapid etching rate, particularly with ferric chloride solutions. However, the etching of other metals, for example, nickel, proceeds at an unacceptably slow rate, even though the oxidation potentials for the reactions are thermodynamically favorable. The kinetics of the reaction are intolerably slow for various reasons, some of which are not completely understood. Conceivably some product of an intermediate reaction blocks the metal surface and impedes the overall etching reaction. Agitation from of solution results in only a minor improvement.

SUMMARY OF THE INVENTION

An object of this invention is to provide an improved process for etching various metals that improves the kinetics of the etching reaction.

Another object of this invention is to provide an improved process for etching metals whereby the reaction rate of the etching reaction is materially increased, and the etching solution is rejuvenated.

Yet another object of this invention is to provide a technique which results in rejuvenation of the etching solution.

In accordance with the aforementioned objectives, there is provided an improved etching method for etching metals wherein the metal to be etched is contacted with an etchant solution containing as an active ingredient an ion or complex ion having a first valence state that is reducible to a second lower state by the metal, the etchant having an active ingredient selected from the group consisting of, but not limited to, ferric ions, ferricyanide ions, ceric ions, dichromate ions, chromate ions, and iodine while simultaneously introducing ozone into the etching solution to rejuvenate the solution and increase the etching rate of the metal.

DESCRIPTION OF PREFERRED SPECIFIC EMBODIMENTS

There are many applications, in particular in the electronics industry, where there is a pressing need to etch relatively thick layers of metals. In a manufacturing environment it is essential that the etching proceed at a rapid rate in order that the etching process will be economically feasible. A typical example of such a need for etching thick metal layers is in the forming of interconnection decals for joining semiconductor devices to electrical networks on supporting substrates.

Nickel is a desirable metal for this purpose. When it is exposed to a ferric chloride solution, however, it may require up to six hours in the bath at room temperature, which is unacceptable throughput in a manufacturing environment. While an aqueous ferric chloride solution etches copper quite rapidly, it does not do the same for nickel. Although the etching reaction of ferric chloride with nickel is thermodynamically quite favorable, the kinetics of the reaction are intolerably slow. Agitation of the solution during etching increases the reaction rate somewhat, but not significantly. The same situation is true in etching other metals such as molybdenum and other alloys that include iron and nickel. Such alloys include Kovar, composed of 29% nickel, 17% cobalt and 53% iron. Kovar is manufactured and sold by Westinghouse Electric Corporation and is known for its thermal expansion characteristics that match hard glass. Another alloy that is difficult to etch is sold under the trademark INVAR and is formed of a mixture of iron and nickel. INVAR has a low coefficient of thermal expansion. Another alloy is sold under the trademark INCONEL composed of a combination of nickel and chromium. INCONEL is manufactured and sold by International Nickel Company and is corrosion resistant. Other alloys that are difficult to etch include brass, which is a combination of copper and zinc; bronze, which is a combination of copper and tin; steel, which is an alloy of iron and from 0.02 to 1.5% carbon; and stainless steel, which is composed of steel with an additive, usually chromium or nickel. The etching of molybdenum is particularly important in the production of masks used in the electronic industry. The etchant solutions used in the practice of our invention depends upon the oxidation of the metal being etched to an ion that is soluble in the etching solution. The etching process involves an oxidation-reduction reaction by an active ingredient in the etchant bath that oxidizes the metal to produce a metal ion which goes into the solution. For example, when etching nickel the following reaction occurs:

$$Ni+2Fe^{3+}\rightarrow Ni^{2+}+2Fe^{+}$$

The etching solutions contemplated for use in the practice of this invention include ferric ions, ferricyanide ions, ceric ions, dichromate, chromate, and iodine. Typically, ferric ions are provided in a ferric chloride solution with a pH in the range of $-1$ to 3. Ferricyanide ions are provided in a potassium ferricyanide solution with a pH in the range of 9 to 14, and ceric ions are provided in a ceric ammonium nitrate solution with a pH in the range of $-1$ to $+2$. Iodine is provided in a $KI\text{-}I_2$ solution. Such solutions are commonly used to strip gold and nickel.

Obviously other cations or anions can replace the nonreactive cations or anions in the above solutions. For example, ferric bromide or ferric nitrate can be used instead of ferric chloride. The etchant solutions can have any suitable concentration of active ingredients that will satisfactorily etch the chosen metal.

It has been discovered that the addition of ozone to the etching solution when etching the aforementioned metals materially increases the etching rate and also rejuvenates the active oxidizing ingredient in the solution. Generally, the etching rate is increased significantly more than solution agitation alone would achieve, as will be proven in the examples that follow. In addition, the rejuvenation of the solution is simultaneously achieved without the addition or formation of agents in the solution that would otherwise hamper the etching reaction and/or reduce the effective life of the solution. The addition of ozone to an etching bath is straightforward, simple in operation, and scalable to large or small operations. The ozone addition leaves no chemical residue in the solution or on the equipment or backing layers. Further, the etch rate enhancement can be controlled by controlling the amount of ozone added to the etching solution.

The redox chemistry of ozone in acid solution is described by the half reaction:

$$O_3+2H^++2e^-\rightarrow O_2+H_2O(E^\circ=+2.07\ V)$$

and in base solution $$O_3+H_2O+2e^-\rightarrow O_2+2OH^-(E^\circ=+1.24\ V)$$

Next to fluorine and its oxides, ozone is the most powerful oxidant. It will thus reverse any redox reaction of $E^\circ<2.07$ V in acid and $E^\circ<1.24$ V in base. Any etchant which involves a redox couple of a potential within these ranges is thus amenable to ozone reoxidation.

The recycling sequence for ferric ions is thus $$Ni+2Fe^{3+}\rightarrow 2Fe^{2+}+Ni^{2+}(E^\circ=1.02\ V)$$

and $$2Fe^{2+}+O_3+2H^+\rightarrow O_2+H_2O+2Fe^{3+}(E^\circ=+1.30\ V)$$

which combine to:

$$Ni+O_3+2H^+\rightarrow O_2+H_2O+Ni^{2+}(E^\circ=2.32\ V)$$

For ferricyanide the rejuvenation reactions are as follows:

$$Mo+6Fe(CN)_6^{3-}+8OH^-\rightarrow MoO_4^{2-}+4H_2O+6Fe(CN)_6^{4-}(E^\circ=+1.28\ V)$$

and $$O_3+H_2O+2Fe(CN)_6^{4-}\rightarrow 2Fe(CN)_6^{3-}+O_2+2OH^-(E^\circ=+1.24\ V)$$

which combine to:

$$Mo+3O_3+2OH^-\rightarrow MoO_4^{2-}+H_2O+3O_2.\ (E^\circ=+2.52\ V)$$

Cerium redox chemistry is reversible as per the reaction:

$$2Ce^{3+}+O_3+2H^+\rightarrow 2Ce^{4+}+H_2O+O_2(E^\circ=+2.07\ V-1.44\ V=+0.63\ V)$$

Iodine/iodide reoxidation is as follows:

$$3I^-+O_3+H_2O\rightarrow I_3^-+2OH^-+O_2(E^\circ=+0.71\ V\ \text{in base})$$

$$3I^-+O_3+2H^+\rightarrow I_3^-+H_2O+O_2(E^\circ=+1.54\ V\ \text{in acid})$$

Chromium reoxidation for rejuvenation of etching is as follows:

$$2Cr^{3+}+4H_2O+3O_3\rightarrow Cr_2O_7^{2-}+8H^++3O_2.\ (E^\circ=+0.74\ V\ \text{i acid})$$

$$2Cr(OH)_3+4OH^-+3O_3\rightarrow 2CrO_4^{2-}+5H_2O+3O_2.\ (E^\circ=+1.36\ V\ \text{in base})$$

Ozone can be produced very easily by commercially available generators. The ozone is generated by passing oxygen through a silent corona discharge. From there the $O_2$–$O_3$ stream is piped directly to the etchant bath where it is preferably passed through a glass frit filter and into the bath to produce bubbles. The product gas can be exhausted up through exhaust vents. The vigor of the bubbling should not be so great as to spatter the solution. A typical gas delivery is 5 cu. ft/hr. of 5 psi gas through 3 liters of 75% w/w ferric chloride. The gas introduced into the etching solution will vary somewhat but is preferably in the range of from 0.1 to 10% ozone, more preferably in the range of 2% to 9% by weight ozone, with the balance being $O_2$. The increase in etching rate of metal achieved by the addition of ozone, compared to etching by conventional techniques, will vary somewhat depending on the metal being etched and the specific etching solution. However, the increase in etching rate is significant and varies from 4 to 20 times the etching rate compared to processes where no ozone is used.

The following examples are presented to illustrate preferred embodiments of the process of our invention, and should not be construed to unduly limit the scope of the claims.

EXAMPLE 1

Metal etch specimens were prepared by placing a release layer of polymethyl methacrylate on a backing sheet, laminating a 1 mil thick nickel foil onto the release layer, placing a photoresist layer over the metal, and exposing and developing the resist layer exposed to form a pattern on the layer. The areas of the photoresist were removed. The resulting specimen was immersed in a 75% w/w ferric chloride solution at a temperature of 20° C., and the etching action observed. When the uncovered nickel areas were removed by etching, the specimen was removed from the etchant bath that the etching time noted. The total time of immersion, necessary to etch through the 1 mil thick nickel layer, was 6 hours.

EXAMPLE 2

An unetched specimen as prepared in Example 1, was immersed in the same ferric chloride solution at the same temperature, and 9% by weight ozone in $O_2$ was bubbled through the solution at a rate of 5 ft.$^3$/hr. at an overpressure of 5 psi. The specimen was removed when the exposed portion of the nickel foil was etched away. The total time of immersion necessary to etch the exposed nickel foil was found to be 53 minutes. This represents a 6.8 fold increase in the etchant rate compared to the process of Example 1. It was also noted that neither the photoresist nor the backing layer was affected by the etching action. This demonstrates a dramatic increase in the etching rate of Ni by ferric chloride achieved by the process of the invention.

EXAMPLE 3

In order to determine what effect the agitation of the solution by itself has on etching rate, a specimen, as prepared in Example 1 was immersed in the same ferric chloride solution at the same temperature in the same tank, and oxygen bubbled through the etchant at a rate of 5 $ft.^3$/hr. at 5 psi. After 32 minutes the specimen was removed, the thickness of the exposed nickel film measured, and the average etchant rate calculated. It was observed that the oxygen agitation produced only a 2.5 fold increase in the etchant rate as compared to Example 1.

EXAMPLE 4

The same procedure described in Example 3 was followed except that nitrogen was bubbled through the etching solution at a rate of 5 $ft^3$/hr at 5 psi. The total time to etch through the nickel layer was calculated and compared to the time and etch rate of Example 1. It was found that nitrogen agitation also produced a 2.5 fold increase in the etchant rate as compared to Example 1. Examples 3 and 4 indicate that the etchant rate can be increased by agitation of the solution, but the increase in rate is materially less than the rate increase achieved by the process of the invention. The similar etch rates using $O_2$ and $N_2$ indicate that the increase is due solely to agitation.

EXAMPLE 5

As a control, a strip of shiny molybdenum metal weighing 3.3510 g was immersed in a spent etchant bath approximately one month old having roughly 22–24% by weight of potassium ferrocyanide plus potassium ferricyanide, plus 1.3% to 2.6% molybdenum (dissolved as molybdate, $MoO_4^{2-}$), with a pH of 12.5, for 30 minutes. The strip was removed and weighed. The weight was 3.1839 g, which represents a 5.0% weight loss.

EXAMPLE 6

The procedure of Example 5 was repeated using molybdenum strips with the same surface area and thickness as the strips used in Example 3, except that oxygen gas was bubbled through the etchant while the molybdenum strip was immersed. The strip underwent a 9.7% weight loss. The increase in the etchant rate was attributed to agitation of the etchant.

EXAMPLE 7

The spent etchant bath of Example 5 was ozonated with a 9% $O_3$ in oxygen for 1 hour, and subsequently a strip of molybdenum was weighed and immersed as the bubbling of $O_3$ in oxygen was continued. The molybdenum strip had the same surface area, and thickness as the strips used in Examples 5 and 6. After 40 minutes the strip was removed and weighed. It was found to have undergone a 34.7% weight loss. A second strip was subsequently weighed and immersed for 1 hour as ozone in oxygen was bubbled through the etchant. After an hour the strip was removed and weighed. It had undergone a weight loss of 38.3%. The experiment proves that spent solutions of potassium ferricyanide can be rejuvenated by ozone, that the etchant rates in such solutions are reproducible, and are significantly higher than when no agitation, or when agitation of the solution is provided.

EXAMPLE 8

An etch bath consisting of 2 liters of $K_3Fe(CN)_6$ (146 gm/liter) with some dissolved molybdenum (9 g Mo/-liter), a pH of 11.5, and a temperature of 46° C. was ozonated as previously described. A Mo sheet with a resist layer thereon defining a pattern was immersed in the bath. After two hours of etching the etchant penetrated through the Mo sheet. After 3 hours of etching the resist layer sheeted off as a brown film. This performance is contrasted with the normal spray etching of the Mo sheet where the etchant is at 60° C., and a pH of 12.5. Even with 30–40 minutes of exposure to the etchant, the resist barely survives. Survival of the resist for 3 hours of etching is unheard of, as is operation at a pH as low as 11.5. The example points up the advantages of the process of the invention i.e., (1) a lower pH permits longer resist life, (2) a lower temperature diminishes vapor loss from the bath and (3) the increased rate of etching improves throughput.

EXAMPLE 9

A depleted aqueous molybdenum etching solution chosen to be regenerated contained originally 215 grams/liter $K_3Fe(CN)_6$, plus 71.6 grams/liter KOH to raise the pH to 13.75. The virgin etchant before depletion has a potential of +0.462 mV. After repeated uses as a molybdenum metal etchant the bath is normally dumped at some arbitrary potential of the order of 0.380 mV.

One liter of this golden solution was ozonated (by the process of the invention) at 5 scf/hr, of 8–9% $O_3$ in $O_2$, for 15 minutes. This turned the solution back to a dark cherry red color. No ozone odor could be detected emanating from the solution during the ozonolysis. The $O_3$ odor was evident only at the end of this period, at which point the ozonolysis was terminated.

The potential of the golden solution was initially measured and found to be +0.398 mV before ozonolysis. The cherry red solution obtained after ozonolysis had a potential of +0.462 mV, indicating that the reconversion of the $Fe(CN)_6^{4-}$ back to $Fe(CN)_6^{3-}$ by the process of the invention was successful.

EXAMPLE 10

A KI-$I_2$ bath, used for stripping gold and nickel was investigated which consisted of the following:

| Species | Concentration | Moles/l |
|---|---|---|
| KI | 479 gm/liter | 2.885 |
| $I_2$ | 118 gm/liter | 0.464 |

The iodine bath solution was depleted by use to the point where it would ordinarily be dumped. A 200 ml aliquot of the depleted KI-$I_2$ was withdrawn from the bath and assayed at 60.3 gm/liter (51% of the original concentration) of $I_2$ by a thiosulfate titration. The aliquot of bath was then ozonated at full power, i.e., 9% $O_3$ in $O_2$ for 10 minutes at 5 $ft.^3$/hr. After 10 minutes, examination revealed that the dispersion tube for introducing $O_3$ was coated with $I_2$ crystals. After one hour of further ozonolysis the solution was again assayed to determine iodine concentration. The thiosulfate titration determined the iodine concentration to be approximately 130 gm/liter, which concentration exceeded the original concentration of the first assay by more than 10%.

EXAMPLE 11

49.17 grams of $(NH_4)_2Ce(NO_3)_6$ was dissolved in 100 ml of water. The solution contained 89.7 mmoles of $Ce^{4+}$, which is theoretically sufficient to etch 1.554 grams of chromium. 15.37 grams of chromium granules, averaging 1 mm in diameter, were added to the solution as oxygen was bubbled through it for agitation. In 15 minutes the granules of chromium were removed and weighed. The original 15.37 grams of granules were reduced to 15.10 grams, a loss of 0.27 grams. The chromium granules were reintroduced into the solution and left there for 5 days, during which time an additional 0.79 grams of chromium dissolved in the ceric ammonium nitrate solution. Subsequently, the etchant solution was decanted from the chromium granules and a 9% $O_3$ in $O_2$ stream bubbled through the solution at a rate of 5 ft.$^3$/hr for three hours to regenerate it. During this time the solution turned from green to orange-red. A potentiometric titration indicted the presence of $Cr_2O_7^{2-}$ as well as $Ce^{4+}$ ions.

The chromium granules were replaced in the etching solution. In only 15 minutes 15.53 grams of chromium were reduced in weight to 15.16 grams, a loss of 0.37 grams. The $O_3$ regenerated solution thus etched chromium at a rate of 37% faster than the initial fresh solution. The chromium (III) product was oxidized by the $O_3$ to the chromium (VI) species, i.e., $Cr_2O_7^{2-}$, as evidenced by the color change of the solution to red.

The example indicates that $O_3$ will recycle the $Ce^{4+}$-/$Ce^{3+}$ redox couple. When the solution is used to etch chromium metal, $Cr^{3+}$ ions are released into the solution. The $O_3$ bubbled through the solution oxidizes the $Cr^{3+}$ ions to $Cr_2O_7^{2-}$. This was clearly evident not only from the potentiometric titration, but also from the deepening red color of the solution as more and more Cr is etched and the Cr ions were reoxidized to $Cr_2O_7^{2-}$ which is a reddish color.

When the $Ce^{4+}$ solution is used to etch chromium, both of the products of the reaction, i.e. $Cr^{3+}$ and $Ce^{3+}$, are susceptible to ozone reoxidation i.e., $$2Cr^{3+}+4H_2O+3O_3 \rightarrow Cr_2O_7^{2-}+8H^+3O_2. \quad (E^\circ=+0.74\ V)$$

and $$2Ce^{3+}+O_3+2H^+ \rightarrow 2Ce^{4+}+H_2O+O_2 (E^\circ=+0.63\ V)$$

The chromium reoxidation will precede the cerium reoxidation because of the higher emf value. When an excess of chromium is present in the solution the $Ce^{4+}$ ions will be depleted, and the rate of etching will drop to nearly zero since the rate is proportional to $[Ce^{4+}]$. Any $Ce^{3+}$ converted back to $Ce^{4+}$ by ozone will immediately be consumed by etching the excess chromium metal present. The recycling was evident when the chromium was filtered from the etchant solution. $O_3$ was then used to regenerate $Ce^{4+}$ in sufficient concentration so that when chromium metal was reintroduced into the etchant an enhanced etch rate was observed.

This Example also illustrates that chromium (III)-Chromium (VI) etching systems can be recycled. $H_2Cr_2O_7$ in $H_2SO_4$ is used to etch copper, iron-cobalt-vanadium alloys, Kovar, nickel-silver alloys, phosphor-bronze, and silver. In general ozone will recycle any candidate species, including products of an etching, to the highest state achievable.

While the present invention has been particularly shown and described with reference to preferred embodiments therefor, it will be understood by those skilled in the art that the foregoing and other changes in form and detail may be made therein without departing from the spirit and the scope of the present invention, as defined in the appended claims.

We claim:

1. An etching process in which a metal is dissolved as cations from a surface of a body by contact with an etching solution comprising, contacting said metal, selected from the group consisting of Ni, Sn, Cu, Cr, and alloys of steel, stainless steel, with an etching solution, said etching solution having an active etching ingredient selected from the group consisting of ferric ions, ferricyanide ions, chromate ions, and dichromate ions, simultaneously introducing ozone into said etching solution to rejuvenate said solution, and to materially increase the etching rate of the metal.

2. The etching process of claim 1 wherein said etching solution includes ferricyanide anions.

3. The etching process of claim 1 wherein said metal is Ni, and said etching solution has ferric ions as an active ingredient, and chloride anions, said solution having a pH in the range of −1 to +3.

4. The etching process of claim 1 wherein said ozone is formed by passing oxygen through a silent corona discharge.

5. The etching process of claim 4 wherein said ozone is bubbled through said etching solution.

6. The etching process of claim 1 wherein said body is comprised of a flexible backing element of an organic dielectric material that supports a layer of said metal.

7. The etching process of claim 6 wherein said body is prepared for selectively etching areas of said metal by depositing, exposing, and developing a resist layer on said metal that blankets selected areas of the metal and prevents contact of said etching solution.

8. The etching process of claim 1 wherein said ozone is introduced into said etching solution in a stream of oxygen and wherein the percent of ozone by weight is in the range of 0.1% to 10%.

9. The etching process of claim 1 wherein Mo is dissolved as anions from a surface of a body by contact with an etching solution, wherein said solution is a basic ferricyanide aqueous solution, simultaneously introducing ozone into said etching solution to rejuvenate said solution, and to significantly increase the etching rate of said solution.

10. The etching process of claim 4 wherein said etching solution is an aqueous solution and further includes potassium or sodium cations.

11. The etching process of claim 10 wherein said etching solution has a pH in the range of 9 to 14.

12. The etching process of claim 11 wherein said body is prepared for selectively etching areas of said metal by depositing, exposing, and developing a layer of resist on said metal that blankets selected areas of the metal and prevents contact of said etching solution.

13. The etching process of claim 12 wherein said ozone is formed by passing oxygen through a silent corona discharge.

14. An etching process in which a metal is dissolved as cations from a surface of a body by contact with an etching solution containing an active oxidizing agent comprising, contacting molybdenum with a solution containing an active agent consisting of a reduction-oxidation couple to be reversed with an electromotive force of less than 2.07 V in an acid solution, and an oxidation-reduction couple to be reversed with an electromotive force of less than 1.24 V in basic solution, introducing ozone into said etching solution to rejuvenate said solution and increase the etching rate.

15. The etching process of claim 14 wherein said etching solution contains ferricyanide ions.

* * * * *